US011732316B2

(12) United States Patent
Chen et al.

(10) Patent No.: US 11,732,316 B2
(45) Date of Patent: Aug. 22, 2023

(54) LEATHER TANNING METHOD USING CHROME-FREE AND FORMALDEHYDE-FREE ADHESIVE

(71) Applicant: FUJIAN AGRICULTURE AND FORESTRY UNIVERSITY, Fuzhou (CN)

(72) Inventors: Nairong Chen, Fuzhou (CN); Yijing Tu, Fuzhou (CN)

(73) Assignee: FUJIAN AGRICULTURE AND FORESTRY UNIVERSITY, Fuzhou (CN)

( * ) Notice: Subject to any disclaimer, the term of this patent is extended or adjusted under 35 U.S.C. 154(b) by 14 days.

(21) Appl. No.: 17/571,522

(22) Filed: Jan. 9, 2022

(65) Prior Publication Data

US 2022/0333217 A1 Oct. 20, 2022

(30) Foreign Application Priority Data

Apr. 19, 2021 (CN) ..... 202110417818.3

(51) Int. Cl.
*C14C 3/28* (2006.01)
*C14C 3/18* (2006.01)

(52) U.S. Cl.
CPC . *C14C 3/28* (2013.01); *C14C 3/18* (2013.01)

(58) Field of Classification Search
CPC ..... C14C 3/18; C14C 3/28
See application file for complete search history.

(56) References Cited

U.S. PATENT DOCUMENTS 3,403,113 A * 9/1968 Ewald ..... C08G 12/34 528/340
3,428,617 A * 2/1969 Sobolev ..... C08F 20/34 162/168.3
4,784,664 A * 11/1988 Siegler ..... C14C 3/02 8/94.19 R
2005/0132499 A1* 6/2005 Vedaraman ..... C14C 1/04 8/94.15

FOREIGN PATENT DOCUMENTS

WO WO 2018/195234 * 10/2018 ..... C14C 1/04

* cited by examiner

*Primary Examiner* — Amina S Khan

(57) ABSTRACT

A leather tanning method using chrome-free and formaldehyde-free adhesive pertains to the technical field of leather tanning, in which the quaternary ammonium salt cationic resin adhesive is used for leather pretanning and retanning. After drying, the leather has excellent performance, which is comparable to traditional chrome and formaldehyde tanned leather. The method solves the drawbacks of using chromium and formaldehyde tanning agents in the leather tanning industry, which pollutes the environment and raises health concerns. The present disclosure has obvious advantages in environmental protection, huge industrial application value, and has broad application prospects.

7 Claims, No Drawings

LEATHER TANNING METHOD USING CHROME-FREE AND FORMALDEHYDE-FREE ADHESIVE

CROSS REFERENCE TO RELATED APPLICATIONS

This application is based upon and claims priority to Chinese Patent Application No. 202110417818.3, filed on Apr. 19, 2021, the entire content of which is incorporated herein by reference.

TECHNICAL FIELD

The present disclosure relates to the technical field of leather tanning, and particularly to a leather tanning method using chrome-free and formaldehyde-free adhesive.

BACKGROUND

Leather, having a three-dimensional network structure composed of collagen fiber bundles, is a product obtained from animal skins and hides being subjected to physical, chemical and/or biological treatments. With excellent physical, mechanical and biological properties, leather has found widespread applications in both daily living and industrial places. Tanning is an inevitable process of treating the raw hides and skins of animal to produce leather, and is also a key and fundamental process which gives leather its qualitative upgrade of protein stability and lays a foundation for subsequent processing and application. Tanning hide into leather involves chemical reactions between the collagen fibre of the raw hide or skin and the tanning agents which is a chemical material, and that's where the leather gets its numerous desirable characteristics. Chrome tanning is currently the most frequently applied tanning process, and about 80-90% of all worldwide leather is chrome tanned. However, there are environmental concerns with the chrome tanning method as chromium may pollute the environment and also maybe harmful to a user's health. For example, a large amount of neutral salt may be used during pickling state carried out in the chrome tanning, and salt of heavy metal chromium in the liquid waste and solid waste containing chromium produced in tanning may all seriously harm the environment. Further, it is also risky for the oxidation of non-toxic trivalent chromium (chromium(III)) in chrome tanned leather to toxic hexavalent chromium (chromium(VI)), which puts user's health in danger. Alternatively, chrome-free materials such as aldehyde-containing groups (e.g. formaldehyde) or its resins may also be used as tanning agents, but there are also health concerns with free formaldehyde which is considered a human cancerogen. Therefore, environmentally friendly leather tanning agents with little or no chromium have become one of the current research hotspots which mainly focus on formaldehyde-free synthetic resins, such as formaldehyde-free triazine resin retanning agent named TPR, POSS/polymer composites containing amino and carboxyl groups, imidazole-type ionic liquid polymers, bio-based polyaldehydes and chitin polymers, etc. However, these materials, as tanning agent, all have the disadvantages of complex synthesis process, inferior tanning effect to chrome tanning, and not suited for large-scale industrial use. So far, there are no reports on the use of quaternary ammonium polymer adhesives as leather tanning agents.

SUMMARY

It is an object of the present disclosure to provide a leather tanning method using chromium-free and formaldehyde-free adhesive, which applies the non-toxic and environmentally friendly quaternary ammonium salt cationic resin adhesive widely used in the paper-making industry to the leather tanning. The quaternary ammonium salt cationic resin adhesive which is easy to cross-link to protein is expected to replace the traditional chrome-based tanning agent and formaldehyde-based tanning agent.

In order to realize the above object, the present disclosure provides the following solution.

A leather tanning method using chrome-free and formaldehyde-free adhesive includes the following steps:

1) mixing quaternary ammonium polymer with water to prepare a quaternary ammonium polymer solution with a mass concentration of 5%-35%;

2) putting animal hide or skin in an acid solution containing sodium chloride and soaking the animal hide or skin for 24 hours, then drying the animal hide or skin at a room temperature;

3) placing dried animal hide or skin in a rotary drum, adding the quaternary ammonium polymer solution, and running the rotary drum at 10 rpm at room temperature in a forward direction for 15 minutes, in a reverse direction for 15 minutes, then in the forward direction again for 15 minutes, and in the reverse direction again for 15 minutes;

4) raising the temperature to 40° C., running the rotary drum at 8 rpm in the forward direction for 15 minutes, in the reverse direction for 15 minutes, then in the forward direction again for 15 minutes, and in the reverse direction again for 15 minutes;

5) stopping rotation of the rotary drum and soaking the animal hide or skin for 12 hours;

6) adding an alkaline solution to adjust a system pH to 6.5-8, running the rotary drum at 8 rpm at room temperature in the forward direction for 5 minutes, in the reverse direction for 5 minutes, then in the forward direction again for 5 minutes, and in the reverse direction again for 5 minutes;

7) taking the resulting animal hide or skin out to dry at room temperature and obtain a leather product.

In some embodiments, the quaternary ammonium polymer is one or more items selected from the group consisting of Kymene Wet-strength Resins, JH1201 resin(polyamidoamine-epichlorohydrin), and poly(dipropylene amine) epichlorohydrin.

In some embodiments, the animal hide or skin is defatted hide or skin of pig, cattle or sheep.

In some embodiments, the acid solution is prepared by sulfuric acid, hydrochloric acid, nitric acid, acetic acid or propionic acid. The alkaline solution is prepared by sodium hydroxide, calcium hydroxide, potassium hydroxide, ammonium hydroxide or triethanolamine.

In some embodiments, a mass ratio of the animal hide or skin to the acid solution is 1:1-5, and a weight ratio of the dried hide or skin to the quaternary ammonium polymer solution is 1:0.5-5.

In some embodiments, a mass fraction of sodium chloride in the acid solution is 3-8%.

In some embodiments, a mass concentration of the alkaline solution is 10-15%.

The present disclosure has the following advantages. The quaternary ammonium polymer is a typical water-based cationic resin which is able to penetrate into the hide or skin during the tanning process. The use of alkali to adjust the system pH promotes the reaction between the quaternary ammonium polymer and amino group, carboxyl group, hydroxyl group, sulfhydryl group and other functional groups of the protein molecule, so as to improve the cross-link density. While, the physical and mechanical properties of the leather are improved, the shrinkage temperature is increased by 20-60%, the tensile strength is increased by 40-80%, and the tearing strength is increased by 20-50%, without the safety concerns over chromium ion which is a heavy metal and formaldehyde which is considered a cancerogen, and the present disclosure is suitable for industrial use to manufacture a wide range of leather products.

DETAILED DESCRIPTION OF EMBODIMENTS

To make the content of the present disclosure readily understandable, the technical solutions of the present disclosure will be further described below in conjunction with specific embodiments. However, it should be understood that the present disclosure is not limited thereto.

Embodiment 1

A leather tanning method using chrome-free and formaldehyde-free adhesive includes the following steps:

1) mixing quaternary ammonium polymer with water to prepare a quaternary ammonium polymer solution with a mass concentration of 5%;

2) putting animal hide or skin in an acid solution containing sodium chloride and soaking the animal hide or skin for 24 hours, then drying the animal hide or skin in the air at a room temperature;

3) placing dried animal hide or skin in a rotary drum, adding the quaternary ammonium polymer solution, and running the rotary drum at 10 rpm at room temperature in a forward direction for 15 minutes, in a reverse direction for 15 minutes, then in the forward direction again for 15 minutes, and in the reverse direction again for 15 minutes;

4) increasing the temperature to 40° C., running the rotary drum at 8 rpm in the forward direction for 15 minutes, in the reverse direction for 15 minutes, then in the forward direction again for 15 minutes, and in the reverse direction again for 15 minutes;

5) stopping rotation of the rotary drum and soaking the animal hide or skin for 12 hours;

6) adding an alkaline solution to adjust a system pH to 6.5-8, running the rotary drum at 8 rpm at room temperature in the forward direction for 5 minutes, in the reverse direction for 5 minutes, then in the forward direction again for 5 minutes, and in the reverse direction again for 5 minutes;

7) taking out the resulting animal hide or skin to dry at room temperature in the air and obtain a leather product.

Further, the quaternary ammonium polymer is Kymene Wet-strength Resins.

Further, the animal hide or skin is defatted hide or skin of pig.

Further, the acid solution was prepared by sulfuric acid and the alkaline solution is prepared by sodium hydroxide.

Further, a mass ratio of the animal hide or skin to the acid solution is 1:1, and a weight ratio of the dried hide or skin to the quaternary ammonium polymer solution is 1:5.

Further, a mass fraction of sodium chloride in the acid solution is 3%.

Further, a mass concentration of the alkaline solution is 10%.

Embodiment 2

A leather tanning method using chrome-free and formaldehyde-free adhesive includes the following steps:

1) mixing quaternary ammonium polymer with water to prepare a quaternary ammonium polymer solution with a mass concentration of 35%;

2) putting animal hide or skin in an acid solution containing sodium chloride and soaking the animal hide or skin for 24 hours, then drying the animal hide or skin in the air at a room temperature;

3) placing dried animal hide or skin in a rotary drum, adding the quaternary ammonium polymer solution, and running the rotary drum at 10 rpm at room temperature in a forward direction for 15 minutes, in a reverse direction for 15 minutes, then in the forward direction again for 15 minutes, and in the reverse direction again for 15 minutes;

4) increasing the temperature to 40° C., running the rotary drum at 8 rpm in the forward direction for 15 minutes, in the reverse direction for 15 minutes, then in the forward direction again for 15 minutes, and in the reverse direction again for 15 minutes;

5) stopping rotation of the rotary drum and soaking the animal hide or skin for 12 hours;

6) adding an alkaline solution to adjust a system pH to 6.5-8, running the rotary drum at 8 rpm at room temperature in the forward direction for 5 minutes, in the reverse direction for 5 minutes, then in the forward direction again for 5 minutes, and in the reverse direction again for 5 minutes;

7) taking out the resulting animal hide or skin to dry at room temperature in the air and obtain a leather product.

Further, the quaternary ammonium polymer is JH1201 resin (polyamidoamine-epichlorohydrin).

Further, the animal hide or skin is defatted hide or skin of cattle.

Further, the acid solution is prepared by hydrochloric acid and the alkaline solution is prepared by potassium hydroxide.

Further, a mass ratio of the animal hide or skin to the acid solution is 1:5, and a weight ratio of the dried hide or skin to the quaternary ammonium polymer solution is 1:0.5.

Further, a mass fraction of sodium chloride in the acid solution is 8%.

Further, a mass concentration of the alkaline solution is 15%.

Embodiment 3

A leather tanning method using chrome-free and formaldehyde-free adhesive includes the following steps:

1) mixing quaternary ammonium polymer with water to prepare a quaternary ammonium polymer solution with a mass concentration of 20%;

2) putting animal hide or skin in an acid solution containing sodium chloride and soaking the animal hide or skin for 24 hours, then drying the animal hide or skin in the air at a room temperature;

3) placing dried animal hide or skin in a rotary drum, adding the quaternary ammonium polymer solution, and running the rotary drum at 10 rpm at room temperature in a forward direction for 15 minutes, in a reverse direction for 15 minutes, then in the forward direction again for 15 minutes, and in the reverse direction again for 15 minutes;

4) increasing the temperature to 40° C., running the rotary drum was run at 8 rpm in the forward direction for 15 minutes, in the reverse direction for 15 minutes, then in the forward direction again for 15 minutes, and in the reverse direction again for 15 minutes;

5) stopping rotation of the rotary drum and soaking the animal hide or skin for 12 hours;

6) adding an alkaline solution to adjust a system pH to 6.5-8, running the rotary drum at 8 rpm at room temperature in the forward direction for 5 minutes, in the reverse direction for 5 minutes, then in the forward direction again for 5 minutes, and in the reverse direction again for 5 minutes;

7) taking out the resulting animal hide or skin to dry at room temperature in the air and obtain a leather product.

Further, the quaternary ammonium polymer is poly(dipropylene amine)epichlorohydrin.

Further, the animal hide or skin is defatted hide or skin of sheep.

Further, the acid solution is prepared by acetic acid and the alkaline solution is prepared by triethanolamine.

Further, a mass ratio of the animal hide or skin to the acid solution is 1:3, and a weight ratio of the dried hide or skin to the quaternary ammonium polymer solution is 1:2.

Further, a mass fraction of sodium chloride in the acid solution is 5%.

Further, a mass concentration of the alkaline solution is 12%.

Performance test: the mass ratio of the tanning agent to the hide or skin of cattle is 1:1, the raw material is put into the rotary drum with a temperature of 30° C. and subjected to forward and backward rotations for 1 h, then the temperature of the rotary drum is increased to 40° C. and the forward and backward rotations are repeated for 1 h. After that, the material is soaked overnight and then dried outdoors for 48 h to obtain the leather products. Performances including tensile strength, swelling rate (SR, the unit of water absorbed for each time unit), shrinkage temperature, tear strength, elongation at break of the obtained leather products made of cattle hide or skin are tested, and the test results are shown in Table 1.

TABLE 1 tanning parameters and product performance of tanned leather

| number | Kymene 450 | JH1201 | poly (dipropylene amine) epichlorohydrin | $H_2O$ | chrome tanning agent | tensile strength/ MPa | swelling rate/% | elongation at break/% | shrinkage temperature/ ° C. | tear strength/ $N \cdot m^{-1}$ |
|---|---|---|---|---|---|---|---|---|---|---|
| 1# | 1 kg | 0 | 0 | 0 | 0 | 45 | 95 | 105 | 88 | 57 |
| 2# | 0 | 1 kg | 0 | 0 | 0 | 48 | 93 | 100 | 91 | 63 |
| 3# | 0 | 0 | 1 kg | 0 | 0 | 43 | 130 | 89 | 90 | 67 |
| control group (water) | 0 | 0 | 0 | 1 kg | 0 | 32 | 215 | 72.5 | 82 | 43 |
| control (group chrome tanning agent) | 0 | 0 | 0 | 0 | 1 kg | 44 | 189 | 97 | 90 | 71 |

The foregoing descriptions are merely preferred embodiments of the present disclosure, and all equivalent changes and modifications made derived therefrom should be considered as falling within the scope of the present disclosure.

What is claimed is:

1. A leather tanning method using chrome-free and formaldehyde-free adhesive comprising:

1) mixing quaternary ammonium polymer with water to prepare a quaternary ammonium polymer solution with a mass concentration of 5-35%;

2) putting animal hide or skin in an acid solution containing sodium chloride and soaking the animal hide or skin for 24 hours, then drying the animal hide or skin at a room temperature;

3) placing dried animal hide or skin in a rotary drum, adding the quaternary ammonium polymer solution, and running the rotary drum at 10 rpm at room temperature in a forward direction for 15 minutes, in a reverse direction for 15 minutes, then in the forward direction again for 15 minutes, and in the reverse direction again for 15 minutes;

4) raising the temperature of the rotary drum to 40° C., running the rotary drum at 8 rpm in the forward direction for 15 minutes, in the reverse direction for 15 minutes, then in the forward direction again for 15 minutes, and in the reverse direction again for 15 minutes;

5) stopping rotation of the rotary drum and soaking the animal hide or skin for 12 hours;

6) adding an alkaline solution to adjust a system pH to 6.5-8, running the rotary drum at 8 rpm at room temperature in the forward direction for 5 minutes, in the reverse direction for 5 minutes, then in the forward direction again for 5 minutes, and in the reverse direction again for 5 minutes;

7) taking the resulting animal hide or skin out to dry at room temperature and obtain a leather product.

2. The leather tanning method using chrome-free and formaldehyde-free adhesive according to claim 1, wherein the quaternary ammonium polymer is poly(dipropylene amine)epichlorohydrin.

3. The leather tanning method using chrome-free and formaldehyde-free adhesive according to claim 1, wherein the animal hide or skin is defatted hide or skin of pig, cattle or sheep.

4. The leather tanning method using chrome-free and formaldehyde-free adhesive according to claim 1, wherein the acid solution comprises acids selected from the group consisting of sulfuric acid, hydrochloric acid, nitric acid, acetic acid or propionic acid, the alkaline solution comprises alkaline agents selected from the group consisting of sodium hydroxide, calcium hydroxide, potassium hydroxide, ammonium hydroxide or triethanolamine.

5. The leather tanning method using chrome-free and formaldehyde-free adhesive according to claim 1, wherein a mass ratio of the animal hide or skin to the acid solution is 1:1-5, and a weight ratio of the dried hide or skin to the quaternary ammonium polymer solution is 1:0.5-5.

6. The leather tanning method using chrome-free and formaldehyde-free adhesive according to claim 1, wherein a mass fraction of sodium chloride in the acid solution is 3-8%.

7. The leather tanning method using chrome-free and formaldehyde-free adhesive according to claim 1, wherein a mass concentration of the alkaline solution is 10-15%.

* * * * *